United States Patent [19]

Okamoto et al.

[11] Patent Number: 4,537,247

[45] Date of Patent: Aug. 27, 1985

[54] HEAT PIPE HEAT EXCHANGER

[75] Inventors: Eiji Okamoto; Yasuhiro Fukaya, both of Kobe; Michio Chikami, Ibaraki, all of Japan

[73] Assignee: Gadelius Kabushiki Kaisha, Japan

[21] Appl. No.: 480,949

[22] PCT Filed: Jul. 21, 1982

[86] PCT No.: PCT/JP82/00283

§ 371 Date: Mar. 21, 1983

§ 102(e) Date: Mar. 21, 1983

[87] PCT Pub. No.: WO83/00380

PCT Pub. Date: Feb. 3, 1983

[30] Foreign Application Priority Data

Jul. 22, 1981 [JP] Japan ..... 56-113527

[51] Int. Cl.[3] ..... F28D 15/00

[52] U.S. Cl. ..... 165/104.14; 165/78; 165/133; 122/DIG. 2

[58] Field of Search ..... 165/104.14, 134, 133, 165/78, DIG. 28; 122/DIG. 2

[56] References Cited

U.S. PATENT DOCUMENTS 4,079,702 3/1978 Furubawa et al. ..... 165/133

FOREIGN PATENT DOCUMENTS 54-47157 4/1979 Japan ..... 165/133
54-152261 11/1979 Japan .
55-20364 2/1980 Japan .

*Primary Examiner*—Albert W. Davis, Jr.
*Attorney, Agent, or Firm*—Kane, Dalsimer, Kane, Sullivan and Kurucz

[57] ABSTRACT

Being a heat pipe heat exchanger wherein a group of heat pipes are arranged in box form and the central part thereof is partitioned, a high temperature fluid being let to flow into one and a low temperature fluid into the other one, respectively, so that, by the specific properties of the heat pipes, the heat given from the high temperature fluid is transferred to the low temperature fluid through the sealed-in fluid in the heat pipes, a plurality of heat pipes of which those on at least the high temperature fluid passage side are bare pipes are arranged to extend over both passages, and the heat pipes on the high temperature fluid passage side are inserted in finless outer pipes. At least the outer surface of these finless outer pipes is treated for resistance to corrosion. Also, these finless outer pipes and the heat pipes are joined by a heat conductive material, so that heat pipes can be easily demounted, and, therefore, the efficiency of the heat exchanger can be varied as required.

5 Claims, 4 Drawing Figures

HEAT PIPE HEAT EXCHANGER

TECHNICAL FIELD

The present invention relates to a heat pipe heat exchanger.

BACKGROUND TECHNIQUE

Heretofore, various types of heat exchangers utilizing heat pipes which transfer heat from a high temperature fluid to a low temperature fluid have been developed.

As a typical one thereof, a fixed-type heat pipe heat exchanger is known wherein a group of heat pipes are arranged in box form and the central part thereof is partitioned, a high temperature fluid being let to flow into one and a low temperature fluid into the other one, respectively, so that, by the specific properties of the heat pipes, the heat given from the high temperature fluid is transferred to the low temperature fluid through the sealed-in fluid in the heat pipes.

However, if this kind of fixed-type heat pipe heat exchanger is used to recover heat effectively from the combustion gases containing dust, sulfur oxide ($SO_x$) and nitrogen oxide ($NO_x$) at high concentration exhausted from large-sized boilers or industrial furnaces for steam-power plant, then, as shown in FIG. 1, these dust and the like adhere to the gaps of a number of fins 2 attached to the outside of heat pipes 1 on the high temperature side to blockade the passage for the high temperature gas, and, also, the surface temperature of the heat pipes on the high temperature fluid side drops below the acid dew point temperature of the exhaust gas, so that the sulfuric acid content in the exhaust gas condenses to adhere to the surface of the heat pipes, this having been the cause of corroding the heat pipes.

Accordingly, the present invention, being one accomplished in view of the above-mentioned circumstances, has for its object the providing of a fixed-type heat pipe heat exchanger which can be used to recover heat from the combustion gases containing dust, sulfur oxide ($SO_x$) and the like at high concentration exhausted from a large-sized boiler or the like of a steam-power plant and utilize the heat effectively, and wherein the gas passages are not blocked up by dust and the like and yet the heat pipes are not corroded by the sulfuric acid content in the exhaust gas.

DISCLOSURE OF THE INVENTION

That is to say, the present invention lies in a heat pipe heat exchanger wherein a passage for low temperature fluid and a passage for high temperature fluid are formed respectively by a partition wall and a plurality of heat pipes of which those on at least the high temperature fluid passage side are bare pipes are arranged to extend over both passages, the heat pipes on the high temperature fluid passage side being inserted in finless outer pipes.

BEST MODE FOR WORKING THE INVENTION

To expound the present invention in more detail, an explanation is given hereunder following the accompanying drawing.

Figure 1:
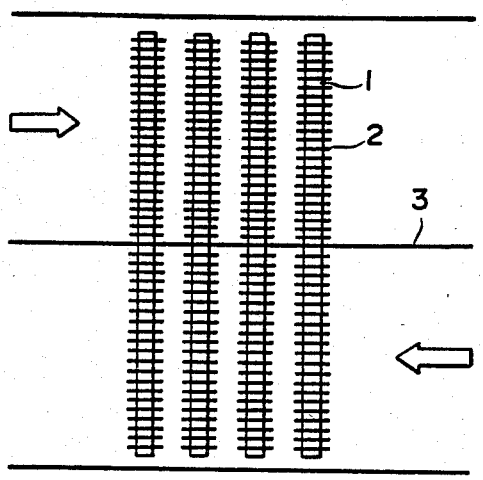
FIG. 1 PRIOR ART
FIG. 1 is an explanation of the conventional general fixed-type heat pipe heat exchanger.
Figure 2:
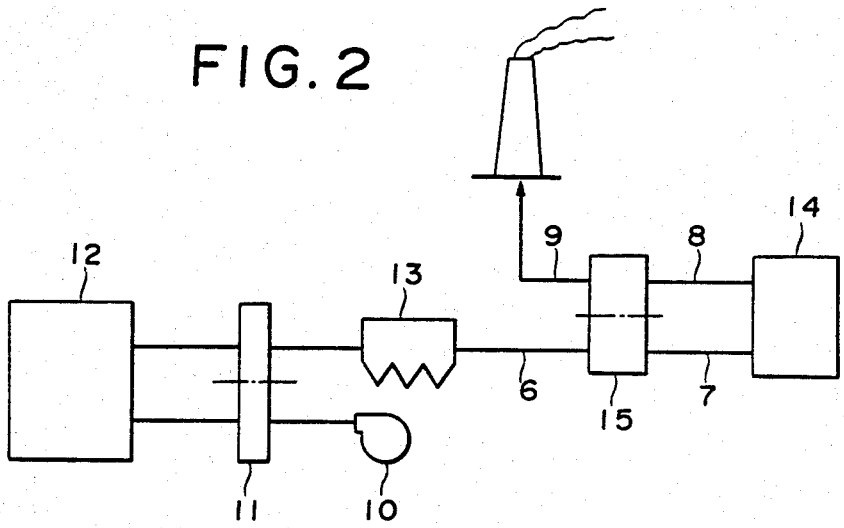
FIG. 2 shows an entire flow sheet of one embodiment of the heat pipe heat exchanger of the present invention, wherein the numeral 15 represents the heat pipe heat exchanger of the present invention.
Figure 3:
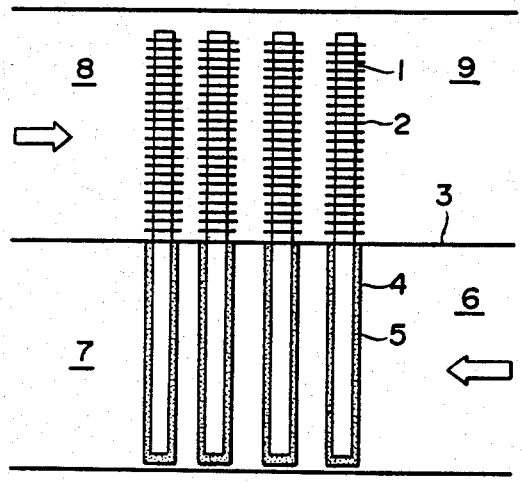
FIGS. 3 and 4 are diagrams of the embodiment of the heat pipe heat exchanger of the present invention.
Figure 4:
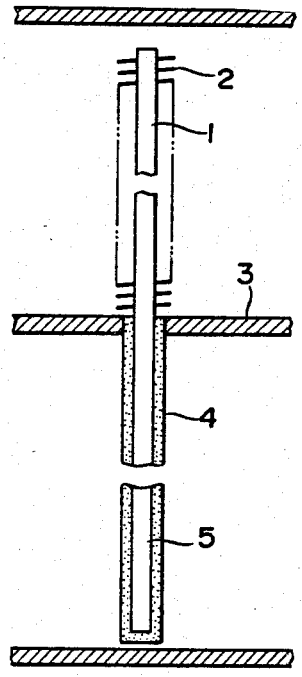

FIGS. 2, 3 and 4 show one embodiment of the present invention, FIG. 2 being an example of arrangement of the heat pipe heat exchanger 15 of the present invention disposed before and after a wet-type desulfurizer 14 for boiler exhaust gas.

The combustion air for boiler 12 supplied by a forced-air blower 10 is first preheated in an air preheater 11 and then supplied to a boiler 12. The exhaust gas from the boiler 12 which uses sulfur-containing fuels such as coal or heavy oil is passed through the air preheater 11 and a dust collector 13 and is fed as a high temperature fluid for the heat pipe heat exchanger 15. The gas temperature at the high temperature fluid inlet duct which varies with operating conditions such as boiler load and the like and overall design requirements is usually from 130° to 170° C. or thereabouts, which is lowered in the heat pipe heat exchanger to from 70° to 110° C. or thereabouts, and thereafter the gas temperature is further lowered in the wet-type desulfurizer 14 to from 40° to 60° C. or thereabouts.

The gas leaving the wet-type desulfurizer is fed to the heat pipe heat exchanger as a low temperature fluid for the heat pipe heat exchanger 15, to have its temperature increased to a sufficient level to prevent the corrosion of the stack or the formation of white smoke and to increase the dispersion of the stack gas, and, thereafter, the gas is discharged through the stack. The acid dew point temperature of the boiler exhaust gas at the high temperature fluid inlet duct in this case necessarily varies with the kind of the boiler fuel, the combustion conditions and the like, but it is in many cases usually from 100° to 150° C. or thereabouts, so that the surface temperature of all or a part of the heat pipes on the high temperature fluid passage side of the heat pipe heat exchanger is lower than the acid dew point temperature.

Under such environmental conditions, the heat pipes in the conventional general heat pipe heat exchanger are corroded by the sulfuric acid content in a very short time, but the heat pipe heat exchanger of the present invention causes no problem of corrosion or blockade and the like due to dust and the like, so that the use for a long period becomes possible.

FIGS. 3 and 4 show the embodiment of the present invention. Heat pipes 1 on the high temperature fluid passage side are bare pipes, which are inserted in finless outer pipes 4 having an enamel coat applied to the outer surface as a treatment for resistance to corrosion. Also, the small gaps between the heat pipes and the finless outer pipes are filled with heat conductive grease as a heat conductive material 5, which acts to effectively transfer the heat given from the high temperature fluid to the heat pipes through the finless outer pipes. Under the above-mentioned corrosive conditions at below the acid dew point temperature, the surface of the outer pipes is in many cases in the wet state, so that dust and the like easily adhere to and collect on their surface, and, therefore, use is made of the finless outer pipes to make it possible to remove the dust and the like easily by air blasting or washing with water, and, in the present embodiment, the outer surface of said finless outer pipes is provided with an enamel coat having a smooth surface to improve the resistance to corrosion and the anti-blockade greatly.

Generally, as metallic materials of high resistance to corrosion, there are special alloys, but they are often expensive. The enameled outer pipes of the present invention are superior in resistance to corrosion and inexpensive.

As another advantage of using the finless outer pipes, incidentally in addition to the above-mentioned advantages, in the case where the necessity arises to replace the finless outer pipes or the heat pipes for some reason such as the use for a long period or the like, they can be replaced easily since the finless outer pipes and the heat pipes are joined by a heat conductive material alone, and, at the same time, it is possible, by joining the finless outer pipes with the partition plate 3, to seal the high temperature fluid and the low temperature fluid easily.

UTILIZABILITY IN INDUSTRY

As above, the heat pipe heat exchanger according to the present invention has many advantages as follows:

(1) The material for the heat pipes themselves may be different from the material for the finless outer pipes, so that, by selecting the material for the finless outer pipes that is suitable for a high temperature fluid, it is possible to lighten the load for the corrosion or the like of the heat pipes themselves.

(2) By applying a treatment for resistance to corrosion to the finless outer pipes, a heat pipe heat exchanger which is far superior in resistance to corrosion is realized, so that the use for a long period becomes possible.

(3) By making the outer pipes finless, dust and the like which adhered to and collected on the finless outer pipes can be easily removed by air blasting or washing with water, so that a heat pipe heat exchanger which is superior in anti-blockade is realized.

(4) By applying an enamel coat as a treatment for resistance to corrosion to the finless outer pipes, a heat pipe heat exchanger is realized which, in addition to having both resistance to corosion as mentioned in 1 above and antiblockade as mentioned in 3 above, is moderate in prince and the outer surface of the finless outer pipes of which is smooth, so that the adhesion of dust and the like is also lowered and the removal thereof is easy.

(5) The heat pipes and the finless outer pipes are joined by a heat conductive material, so the heat pipes can be easily demounted, and, therefore, the efficiency of the heat exchanger can be varied as required.

(6) It is possible, by joining the finless outer pipes with the partition plate, to easily effect the sealing of high temperature fluid and low temperature fluid.

We claim:

1. A heat pipe heat exchanger comprising:

a low temperature fluid passage and a high temperature fluid passage defined by a partition board;

a plurality of heat pipes extending over the entire width of said passages, said heat pipes being bare at least at the high temperature fluid passage side;

finless outer pipes coated at the outer surface with enamel for corrosion protection, said heat pipes at the high temperature fluid passage side being removably inserted into said finless outer pipes; and a heat conductive material disposed between said heat pipes and said finless outer pipes.

2. A heat pipe heat exchanger as described in 1 of the scope of demand characterized in that said low temperature fluid and high temperature fluid are both gases.

3. A heat pipe heat exchanger as described in 1 or 2 of the scope of demand characterized in that at least the outer surface of said finless outer pipes is treated for resistance to corrosion.

4. A heat pipe heat exchanger as described in 3 of the scope of demand characterized in that said treatment for resistance to corrosion is effected with enamel.

5. A heat pipe heat exchanger as described in 1, 2, 3 or 4 of the scope of demand characterized in that a heat conductive material is inserted in between said finless outer pipes and heat pipes.

* * * * *